United States Patent [19]

Lutus et al.

[11] Patent Number: 4,723,150

[45] Date of Patent: Feb. 2, 1988

[54] DUST CONTROL METHOD AND APPARATUS

[75] Inventors: Arthur C. Lutus; Victor B. Van Blerk, both of San Jose, Calif.

[73] Assignees: Ricoh Company, Ltd., Tokyo, Japan; Ricoh Systems, Inc., San Jose, Calif.

[21] Appl. No.: 550,118

[22] Filed: Nov. 9, 1983

[51] Int. Cl.[4] ..... G03G 21/00

[52] U.S. Cl. ..... 355/15; 355/77; 430/125

[58] Field of Search ..... 355/15, 3 R, 3 CH, 77; 430/125; 361/225

[56] References Cited

U.S. PATENT DOCUMENTS 4,481,275 11/1984 Iseki et al. ..... 355/15 X

*Primary Examiner*—R. L. Moses

*Attorney, Agent, or Firm*—Flehr, Hohbach, Test, Albritton & Herbert

[57] ABSTRACT

In an electrophotographic copying system designed according to the present invention, a transparent conducting plastic layer is placed between the drum surface and the red/green electroluminescent panel. This layer is either grounded or is biased to repel the electrically charged toner.

15 Claims, 1 Drawing Figure

DUST CONTROL METHOD AND APPARATUS

Figure 1:
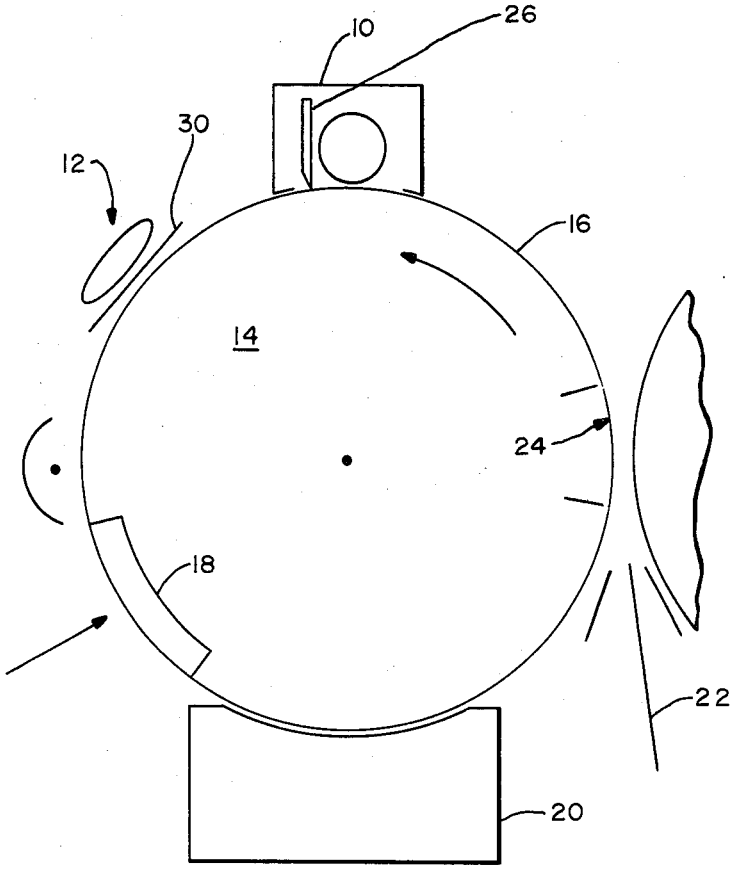

The present invention relates generally to electrophotographic copying apparatus in which electrically charged toner of one polarity transferred from an oppositely charged electrostatic image on the outer surface of the photoconductive drum to the front side of a blank sheet for transforming the latter into an intended copy as the back side of the sheet engages the outer surface of the transfer roll positioned adjacent the drum. This invention relates particularly to apparatus and method for controlling toner residue which is thrown into the air adjacent the photoconductive drum when that drum's image area is wiped clean to prepare it for the next exposure cycle.

The present invention is especially suitable for use in a typical electrophotographic apparatus of a type which is presently being used in industry. Such apparatus typically includes a rotating photoconductive drum, means for placing an electrostatic image corresponding to an original to be copied on the outer circumferential surface of the drum, means for applying toner to the image bearing surface in order to develop the image with toner, and means for transferring the applied toner from the drum surface to a bland sheet of paper so as to transform the latter into a copy of the original. The toner particles are typically electrically charged heat fusable particles which are applied to the electrostatic image and attracted thereto.

After development of the image, apparatus must be provided for cleaning residual toner which is not transferred from the latent image to the paper copy from the image area on the photoconductive drum surface. Typically, a doctor blade or the like is moved into and out of engagement with the drum surface at appropriate times by means of a solenoid actuator or the like. While this type of arrangement is generally satisfactory for the intended purpose of removing toner from the drum, it has been found that the solenoid actuated movement of the cleaning blade is sufficiently abrupt to cause some residual toner to be thrown into the surrounding air, where it can come into contact with and impair the operation of nearby elements of the copying apparatus.

It is a primary objective of the present invention to overcome the above problem in an uncomplicated reliable and economical fashion.

The problem of residual toner is especially apparent with respect to the discharge lamps, typically red and green, which are employed in photocopiers of this type to prefatigue or discharge the surface of the drum. Because of the sequence of steps which is followed in forming, developing, and then discharging the latent image from the surface of the drum, these lamps must be typically located adjacent the wiper or doctor blade. Therefore, over a period of time, it is not unusual for a significant amount of residual toner to collect on the surface of the lamps, impeding their effectiveness. Since the particles are charged, and are quite small, it becomes extremely difficult to effectively clean these discharge lamps. This is espespecially a problem in compact photocopiers such as are presently used in the industry wherein the stations of the development process are located closely adjacent one another, and the clearance for insertion and removal of parts can be extremely tight, especially with parts such as these lamps do not need to be frequently accessed for servicing.

Therefore a more particular objective of the present invention is to more effectively shield these red/green conditioning lamps from the impact of residue toner.

Another objective of this invention is to provides means for effectively shielding these conditioning lamps from residue toner, which shielding means may itself be easily accessed for cleaning of the residue toner therefrom.

In a preferred embodiment of the present invention, a transparent conducting plastic layer is placed between the drum surface and the red/green electroluminescent panel. This layer is either grounded or is biased to repel the electrically charged toner. It has been found that by the introduction of this shield, the deposition of toner on the electroluminescent lamps was greatly reduced. The positioning of this shield in front of the electroluminescent panel is especially important because in raising the cleaning blade which has wiped the latent image area of the surface, it has been found that toner becomes airborne and is transported in the air film carried along with the drum surface as it proceeds to the following station. Some air turbulence exists in this air film, causing toner to be thrown against and deposited on portion of the apparatus stationed around the drum. The immediately adjacent eletroluminescent panel, i.e. immediately adjacent the cleaning station, receives the majority of this toner deposit. It has been found, however, that the introduction of this shield successfully reduces deposition of toner on the electroluminescent panel, expanding the effectiveness of this light emitting panel.

The apparatus which achieves the objectives and provides the features recited above will be described in more detail hereinafter in conjunction with the drawing wherein:

FIG. 1 is a cross-sectional view of a photoconductive drum and the relevant stations incorporated in a photocopier, especially the cleaning station and electroluminescent panel station.

This FIGURE illustrates an arrangement for preventing residual toner from settling on dirt sensitive components of the copying apparatus, and especially the electroluminescent panel which is positioned adjacent the cleaning station.

An arrangement 10 for cleaning residual toner from the surface of the photoconductive drum 14, and an arrangement for shielding the electroluminescent panels 12 from any airborne residual toner, are shown at the top and appear left of the FIGURE.

To put the invention in the context of the entire system, a photoconductive drum 14 is shown having an outer circumferential surface 16. While not shown in detail, the overall electrophotographic copying apparatus includes means for rotating the drum 14 in a controlled way; means for placing an electrostatic image corresponding to an original to be copied on the surface 16 of the drum in a latent image area 18; developing means 20 for applying toner to the image bearing surface in order to develop the image with the toner; and means for transferring the applied toner from the drum surface to a blank sheet of paper 22 within a transfer region 24 to transform the sheet into a copy of the original. After a copy has been made at the transfer nip 24, the image area 18 continues to rotate toward the cleaning station 10.

This station 18 is specifically provided because there is typically untransferred toner remaining on drum surface 14. This residual toner must be removed before the copying process can be repeated. The challenge which must be met by the cleaning apparatus is that the toner particles are electrostatically charged to a polarity opposite that of the image on the surface of the drum so that the particles are attracted to the latent image and held until transferred to the blank paper 22 within the transfer nip. It is apparent that some pressure must be exerted by the wiper blade 26 against the surface 16 of the drum in order to remove the toner from the surface of the drum. As the wiper blade 26 passes across the latent image area 18, some of the toner collects on the wiper blade. Some further small portion of the residual toner is pushed across the latent image surface and deposited to the rear of the image surface in a nonimage area of the photoconductive drum. When the blade has passed across the entire latent image area, it is retracted away from the surface of the drum. This retraction is provided so that the drum may carry any toner collected by the cleaning blade in the non-image area back to the developer station 20 for recovery.

During this raising of the cleaning toner blade 26, because of the inertia of the particles resting on the surface of the blade, some of them will inevitably become airborne. Further, due to the continuous rotation of the photoconductive drum 14, there will be a film of air or an air flow along the surface of the photoconductive drum. This air flow will pick up and carry some of the residual toner particles with it as the surface of the drum moves to the succeeding stations.

The station next to the cleaning station and most sensitive to unwanted deposition of any of these toner particles is the electroluminescent panel 12 which is used to precondition the drum. As the drum surface 16 passes from station to station, turbulence exists in this film of air causing toner to be deposited on items stationed around the drum such as the electroluminescent panel 12. For this reason, a transparent conducting plastic layer 30 is preferably located between at least a portion of the electroluminescent panel (the green light portion is most sensitive to toner deposition) and the surface 16 of the drum. This layer is preferably either connected to ground, or biased to repel the toner. The results of this placement of the shield will be an inhibition of the attraction and settling of toner dust on the lamps 12.

It has been found that this panel 30 is of great utility in reducing the deposition of residual toner particles on the lamps. It further appears that to the extent that some toner may end up being deposited on the shield 30 rather than on the luminescent panels, that this shield would be easier to handle, remove, clean and replace in the machine than the removal and cleaning of the lamps themselves. Therefore, the incorporation of this shield in the above system has significant operational advantages in maintaining the full utility of this system.

Other alternative embodiments of this invention may occur to a person skilled in the art who has studied the subject patent application. Use of such protective shields may be found to be of utility in protecting other internal areas of the copying apparatus, especially in the highly compact units which proliferate in todays market place. Therefore, the scope of this invention is not to be limited to the preferred embodiment disclosed herein, but only by the claims appended hereto.

What is claimed:

1. In an electrophotographic copying apparatus including a rotating photoconductive drum, means for placing an electrostatic image corresponding to an original to be copied on the outer circumferential surface of the drum in an image area of said drum, means for applying toner in said image area to said image bearing surface in order to develop said image with said toner, said toner comprising particles charged to a first polarity, and means for transferring the applied toner from said drum surface to a blank sheet of paper so as to transform the latter into a copy of said original, the improvement comprising an arrangement for cleaning residual toner from said drum surface immediately after said copy has been made without undue dispersion of said toner in said copying apparatus, said arrangement including:

(a) means adapted to engage said drum surface directly as the latter rotates so as to wipe any residual toner from the image area of said engaged surface and a conductive shield overlying an area of said apparatus to be protected from said toner residue.

2. An apparatus as claimed in claim 1 further comprising light emitting means adjacent said drum form conditioning said drum surface, said conductive shield being disposed between said light emitting means and said drum.

3. The improvement according to claim 2 wherein said conductive shield is grounded.

4. The improvement according to claim 2 wherein said conductive shield is biased to the same polarity as the polarity of said charged particles.

5. The improvement according to claim 2 wherein said conductive shield is transparent.

6. In an electrophotographic copying apparatus including a rotating photoconductive drum, means for placing an electrostatic image corresponding to an original to be copied on the outer circumferential surface of the drum, means for applying toner comprising particles charged to a first polarity to said image bearing surface in order to develop said image with said toner, means for transferring the applied toner from said drum surface to a blank sheet of paper so as to transform the latter into a copy of said original, means for cleaning residual toner from said drum surface immediately after said copy has been made, including:

(a) means adapted to engage said drum surface directly as the latter rotates so as to wipe any residual toner from the engaged surface; and (b) means supporting said wiping means for movement between a first position in direct engagement with said drum surface and a second position out of engagement therewith; and (c) light emitting means adjacent said wiping means for conditioning the surface of said drum, including a toner shielding cover between said light emitting device and said developing drum.

7. An apparatus as claimed in claim 6 wherein said cover comprises a conductive material.

8. An apparatus as claimed in claim 7 wherein said cover is grounded.

9. An apparatus as claimed in claim 8 wherein said cover is biased to the same polarity as the charge on said particles.

10. In an electrophotographic copying apparatus including a rotating photoconductive drum, means for placing an electrostatic image corresponding to an original to be copied on the outer circumferential surface of the drum, means for applying toner to said image bearing surface in order to develop said image with said toner, and means for transferring the applied toner from said drum surface to a blank sheet of paper so as to transform the latter into a copy of said original, the improvement comprising a method of cleaning residual toner from said drum surface immediately after said copy has been made, said method including the steps of:

(a) providing a wiping member adapted to engage the drum surface directly as the latter rotates in order to wipe any residual toner from the engaged surface;

(b) supporting said wiping member for movement between a first position in direct engagement with said drum surface and second position out of engagement therewith whereby said toner is moved to a non-imaged area of said drum; and (c) shielding portions of said apparatus susceptible to said toner dust with a conductive shield biased to repel said toner.

11. A method as claimed in claim 10 wherein said shield is grounded.

12. A method as claimed in claim 10 wherein said shield is biased to the same polarity as that of said toner.

13. A method as claimed in claim 10 wherein said apparatus further includes light emitting means positioned to condition said drum, said method including positioning said shield between light and said drum.

14. A method of preventing the scattering of residual charged toner from a movable photosensitive member of an electrostatic copying of the type also including a corona discharger for charging said photosensitive member, means for forming on the thus charged photosensitive member an electrostatic latent image of an original to be copied, a development means disposed downstream of said corona discharger with respect to the direction of movement of said photosensitive member and having a development means for applying toner, charged at a polarity opposite to that of said photosensitive member, to said photosensitive member and thereby to develop said electrostatic latent image into a toner image, means for transferring said toner image to a recording sheet, and a blade member positioned downstream of said transferring means and upstream of said corona discharger, said method comprising:

maintaining said blade member in sliding contact with said photosensitive member during a first mode of operation of said copying machine in which an image is formed on said photosensitive member and transferred therefrom to a recording sheet, thereby blocking from movement with said photosensitive member residual charged toner not transferred to the recording sheet, and thus maintaining a mass of the thus blocked toner at a position on the upstream side of said blade member;

removing said blade member from contact with said photosensitive member during a second mode of operation of said copying machine in which no image is formed on said photosensitive member, and thereby allowing said mass of toner to move with said photosensitive member toward said development means; and during said second mode of operation applying to a member of said copying machine, other than said photosensitive member and positioned between said blade member and said development means, a bias potential of the same polarity as that of said toner, and thereby repelling said mass of toner toward said photosensitive member.

15. A method according to claim 14, wherein said bias potential is of the same polarity as said charged toner with respect to ground potential.

* * * * *